US006073999A

United States Patent [19]

Crane

[11] Patent Number: 6,073,999

[45] Date of Patent: Jun. 13, 2000

[54] COMBINATION MUSICAL INSTRUMENT STAND AND CHAIR

[76] Inventor: Peter Crane, Rowley Jerome Rd., Fabius, N.Y. 13063

[21] Appl. No.: 09/211,082

[22] Filed: Dec. 14, 1998

[51] Int. Cl.[7] ..... A47C 9/08

[52] U.S. Cl. ..... 297/186; 297/188.01; 84/421

[58] Field of Search ..... 297/186, 188.01, 297/217.4; 84/421

[56] References Cited

U.S. PATENT DOCUMENTS

| | | | |
|---|---|---|---|
| D. 173,590 | 11/1954 | Phillips | 297/188.01 |
| 2,505,882 | 5/1950 | Cassato . | |
| 2,607,398 | 8/1952 | Andrews | 297/188.01 |
| 3,096,677 | 7/1963 | Ryan . | |
| 3,259,428 | 7/1966 | Wenger et al. . | |
| 3,710,670 | 1/1973 | Winkler . | |
| 4,112,807 | 9/1978 | Quibell . | |
| 5,739,449 | 4/1998 | Torres, Jr. . | |
| 5,744,738 | 4/1998 | Gatzen . | |

*Primary Examiner*—Anthony D. Barfield
*Attorney, Agent, or Firm*—Wall Marjama Bilinski & Burr

[57] ABSTRACT

A drum stand for an African drum includes a rigid frame that is connected to a seat. The frame includes at least two legs and an opening to accept the drum wherein the drum rests in the frame and wherein the drum is suspended above the ground whereby an arcuate portion of the lower opening of the drum contacts the ground.

4 Claims, 2 Drawing Sheets

COMBINATION MUSICAL INSTRUMENT STAND AND CHAIR

FIELD OF THE INVENTION

This invention relates to musical instrument stands, and more specifically relates to a drum stand that includes a seat.

BACKGROUND OF THE INVENTION

There are various sized and shaped drums that are played by using different striking objects including the bare hands. One type of drum is generically known as an African drum. The African drum is typically distinguished by a main section constructed of wood and/or fiberglass, often ornamentally carved wood. The shape of the main section is generally cylindrical with a larger radius opening at the top and a smaller radius opening in the opening. The top of the main section is covered by an animal skin or synthetic material which is tautly drawn over the entire opening. The skin is secured to the main section by an intricately weaved rope system. The secured taunt skin serves as the drum playing surface. The smaller opening at the bottom is uncovered and serves to allow for the escape of sound waves and air pressure, each of which are built-up on the interior of the main section during play. The drummer typically stands, holds the drum between the knees and tilts the drum slightly while playing. In addition, the standing drummer can utilize a strap that is attached to the drum wherein the drummer drapes the strap over the shoulders and the weight of the drum is borne by the drummer. Alternatively, the drummer can sit on a stool and hold the drum between their legs.

There is known in the art a number of devices that act as musical instrument holders with some type of provision for seating. One of interest is disclosed in U.S. Pat. No. 2,505,882 to Cassato. The Cassato '882 patent discloses a drum support device that includes a stool attachment that is capable of receiving at one end the leg of a stool and at the other end is adapted to receive an instrument holder that can be positioned in a number of configurations. The longitudinal space between the stool and the drum is adjustable.

Another device is disclosed in U.S. Pat. No. 5,744,738 to Gatzen. The Gatzen '738 patent discloses a rigid frame that supports a mount for musical drums and a seat for the drummer. The seat is adjustable and accommodates the drummer in a recumbent position. A plurality of drums and cymbals are mountable upon the frame. The device is intended to provide vibrational feedback to the drummer.

Another musical instrument stand is disclosed in U.S. Pat. No. 4,112,807 to Quibell. The Quibell '807 patent discloses a conga drum set that includes a stand for the drums. The set includes a frame to which is attached at least one conga drum, the drum being attached to the frame through the use of band that fits about the drum. A piston rod is disposed within the drum and is operated by a pedal, whereby the axial movement of the piston within the drum operates to change the pitch of the drum.

Although many of the devices known in the prior art are useful, there are a number of problems that are associated with the playing of an African drum that heretofore have remained unsolved. Most significantly, an African drum can weigh a substantial amount and the drummer suffers fatigue caused by the continuous standing and holding of the drum, whether holding the drum by using the legs or by supporting the drum with a strap. When playing while seated, the legs of the drummer become fatigued caused by the continuous support of the drum. In addition, conventional seats do not place the drum and drummer in a convenient spacial relationship to each other in order to allow the drummer to comfortably play the drum for extended periods of time. Also, when using a conventional seat, the fatigued drummer will sometimes resort to allowing the drum to sit in a vertically upright position, thereby blocking the lower opening of the drum which deadens or diminishes the quality of the sound of drum.

OBJECTS AND SUMMARY OF THE INVENTION

It is therefore an object of the invention to provide an improved stand for an African type drum that includes a seat for the drummer.

It is another object of the invention to provide an improved stand for an African type drum that includes a seat for the drummer and positions the drum during play to optimize the sound characteristics of the drum.

It is yet another object of the invention to provide an apparatus to lessen the fatigue of a drummer when playing an African type drum for extended periods of time.

These and other objects are obtained by a providing a drum stand for an African drum that includes a rigid frame that is connected to a seat. The frame includes at least two legs and an opening to accept the drum wherein the drum rests in the frame and wherein the drum is suspended above the ground whereby an arcuate portion of the lower opening of the drum contacts the ground.

BRIEF DESCRIPTION OF THE DRAWING

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
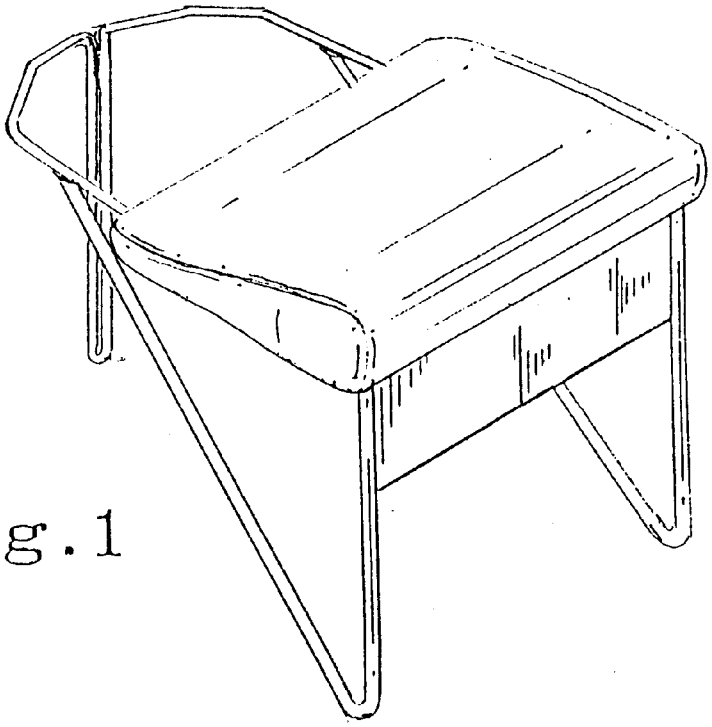
FIG. 1 is a side elevation of the stand including a seat for the drummer.

Referring now to FIG. 1, there is shown an African type drum stand 10 including a seat 12 that embodies the preferred mode of the present invention. The stand 10 is formed by a frame 14, which preferably is constructed of rigid metal, plastic or the like. The frame 14 is preferably formed to comprise three supporting surfaces or legs 16. Of course, the legs 16 may be formed independently of the frame 14 and attached to the frame 14 by welding or other suitable means to connect the legs 16 as one skilled in the art would recognize. Similarly, the number of legs 16 may vary without departing from the objectives of the present invention. For example, the number of legs could be as low as two if the legs were configured in an S-bent shape.

The stand 10 includes a seat 12 that is either integral to or attached to the frame 14 by any suitable means, including adhesives, spot welding or connectors. The seat 12 is preferably configured as a flat horizontal seating surface without the traditional seat back or seat arms. The seat 12 is positioned off the ground at a height that optimizes the comfort of the drummer while the drummer is playing.

Figure 2:
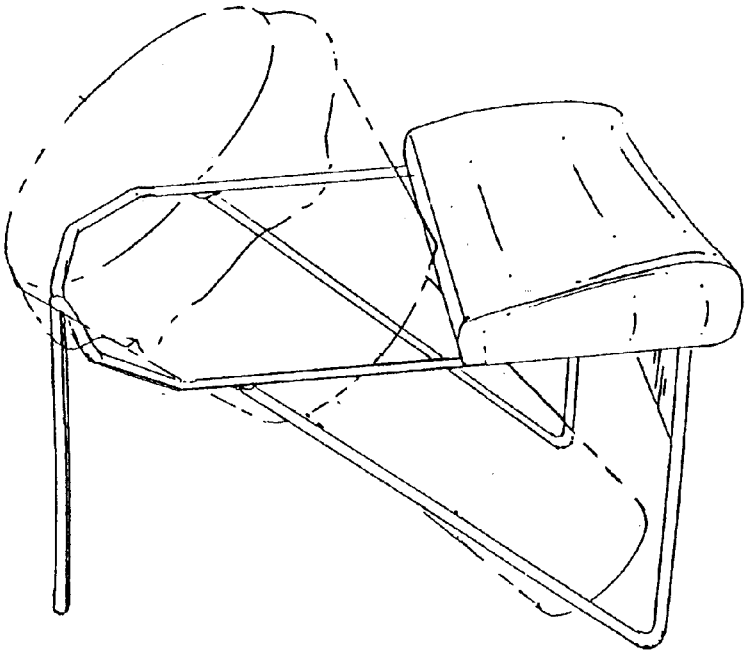
FIG. 2 is a side elevation of the stand including a seat for the drummer with a phantom depiction of an African drum in place.
Figure 3:
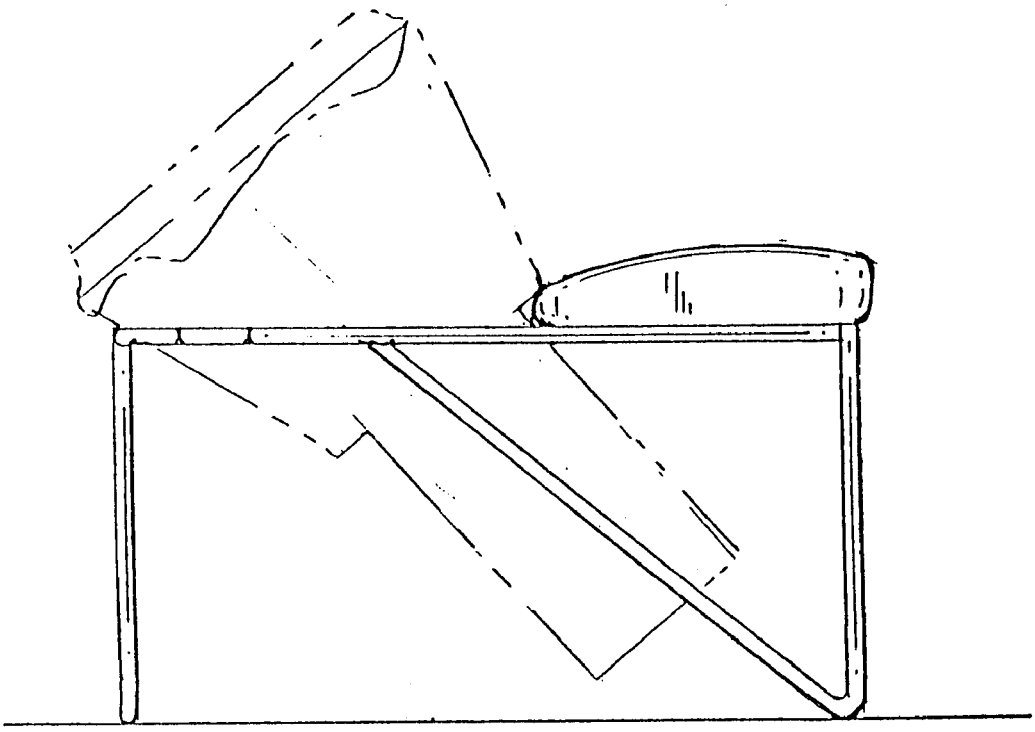
FIG. 3 is a side elevation of the stand including a seat for the drummer with a phantom depiction of an African drum in place.

The frame 14 is formed to provide an opening 18 which is located directly in front of the seat 12. Referring to FIGS. 2 and 3, the opening 18 is shaped and sized to support an African type drum 20. The frame 14 includes drum supporting sections 22 that are placed to optimize the spatial relationship between the drummer and the drum 20. When the drum 20 is placed into the opening 18, the drum 20 is supported by the frame 14 so that the playing surface 21 of the drum declines away from the drummer, a position which optimizes the comfort of the drummer. The frame 14 also supports the drum 20 so that the bottom opening 24 of the drum 20 contacts the ground along an arcuate portion of the opening 24. By suspending the bottom opening 24 in this position, the sound quality of the drum 20 is maximized. Although not shown, the frame 14 can be padded to prevent scratching or other damage to the drum 20.

One of the features of the stand 10 is the compact size. The compact size of the stand allows the drummer to easily transport and set up the stand 10. The drummer merely places the stand 10 at the desired area in which to play and inserts the drum 20 into the opening 18 of the frame 14. The drummer straddles the stand 10 and sits on the seat 12 while facing the drum 20.

While the present invention has been particularly shown and described with reference to the preferred mode as illustrated in the drawings, it will be understood by one skilled in the art that various changes in detail may be effected therein without departing from the spirit and scope of the invention as defined by the claims.

I claim:

1. A drum stand and seat combination for an African drum having a lower opening and atop playing surface, said stand comprising:

a rigid frame, said frame connected to a seat, said frame including at least two legs, said frame including an opening wherein said opening is shaped to accept the African drum such that the drum rests in said frame whereby the drum is suspended and the top playing surface declines away from said seat.

2. The drum stand of claim 1 wherein:

said seat is positioned on said frame directly behind said opening.

3. The drum stand of claim 1 wherein:

said rigid frame comprises metal.

4. The drum stand of claim 1 wherein:

said rigid frame comprises plastic.

* * * * *